US007837171B1

(12) United States Patent
Otake

(10) Patent No.: US 7,837,171 B1
(45) Date of Patent: Nov. 23, 2010

(54) PURSE HANGER WITH EXTENDIBLE SHELF

(76) Inventor: Yoko Otake, 11500 Olympic Blvd., #400, Los Angeles, CA (US) 90064

( * ) Notice: Subject to any disclaimer, the term of this patent is extended or adjusted under 35 U.S.C. 154(b) by 0 days.

(21) Appl. No.: 12/538,057

(22) Filed: Aug. 7, 2009

(51) Int. Cl.
*B42F 13/00* (2006.01)

(52) U.S. Cl. ..... 248/339; 248/914

(58) Field of Classification Search ..... 248/317, 248/304, 339, 914
See application file for complete search history.

(56) References Cited

U.S. PATENT DOCUMENTS 4,312,455 A * 1/1982 Weber ..... 211/119.005
5,094,417 A * 3/1992 Creed ..... 248/215
5,480,075 A * 1/1996 Robinson ..... 223/88
7,207,088 B2 * 4/2007 Adams et al. ..... 16/413
7,389,966 B1 * 6/2008 Hunter ..... 248/304
2005/0056746 A1 * 3/2005 Landver ..... 248/227.1
2005/0161570 A1 7/2005 Bauerly
2009/0109027 A1 * 4/2009 Schuller ..... 340/568.1
2010/0012806 A1 * 1/2010 Yap et al. ..... 248/304

* cited by examiner

*Primary Examiner*—Ramon O Ramirez
(74) *Attorney, Agent, or Firm*—Marc E. Hankin; Kevin Schraven

(57) ABSTRACT

The invention is a purse hanger with an extendible shelf, balance arms, and a key ring. The purse hanger engages tables and other relatively flat surfaces, including tables with flat sides.

21 Claims, 7 Drawing Sheets

PURSE HANGER WITH EXTENDIBLE SHELF

BACKGROUND OF THE INVENTION

This invention generally relates to hanging devices. Specifically, it pertains to a hanger for purses and includes an extendible shelf.

A purse or other type of personal bag is an important useful accessory for many people. A purse frequently holds many items of a personal nature, including a wallet, identification, grooming products, or even medicine. For thousands of years, the purse has also been a fashion accessory, and most purses today are made to complement the style of the wearer. As such, purses not only contain valuable goods, but are frequently very valuable themselves. Indeed a designer brand purse can cost thousands of dollars. A purse placed on the floor or on the back of a chair is easily stolen or soiled. For these reasons, purse wearers are hesitant to place a purse on the floor or on the back of a chair when seated at a bar or a table.

Over eighty years ago, a device known as a purse hanger or purse hook, was developed that allows a purse owner to hang the purse from some types of tables. Purse hangers, at their most basic, consist of a double headed and frequently "S" shaped hook. One head of the hook engages the table and swings over the side of the table. The second head of the hook allows the purse to hang down from just below the underside of the table. Recently, many purse hangers available on the market have included fashionable designs and even jewelry to make them look more attractive. Additionally, because tables come in many shapes and sizes, some purse hangers have even incorporated adjustable parts to compensate for the various thicknesses of the tables.

One such purse hanger that is fashionable and adjustable is disclosed by United States Published Patent Application Number 2005/0161570, filed by Bauerly. Bauerly shows a flat table engaging member and an adjustable table hook. However, neither Bauerly nor any other purse hanger created prior to the present invention has been designed to compensate for a table of any thickness, including a table with no lip at all or substantially flat sides. Moreover, none of the prior purse hangers includes its own extendible shelf that allows the user to hold a book, notebook, or other small item that cannot be held by a standard purse hanger. Furthermore, the prior purse hangers do not allow a purse to hang down from the top hook, as opposed to hanging the purse from the bottom hook, so the purse does not touch the floor if the table or chair seat is low to the ground.

Thus, there is a long felt need in the art for a purse hanger that is designed to be used for tables and other essentially flat surfaces with various thicknesses and includes an extendible shelf or rack.

BRIEF SUMMARY OF THE INVENTION

To minimize the limitations in the prior art, and to minimize other limitations that will become apparent upon reading and understanding the present specification, the present invention discloses a purse hanger with an extendible shelf. The purse hanger is compatible with tables and other essentially flat surfaces of any thickness, including tables with no lips or flat sides.

One embodiment of the invention is a purse hanger, comprising: a top hook; a stem; a plurality of bottom arms. Preferably the bottom arms are extendible and collapsible, and when extended they create a shelf. The top hook is preferably configured to engage an elevated surface and while engaged the shelf is essentially parallel to a ground. The bottom arms of the invention are preferably rotatable and may even be clips.

Another embodiment of the invention includes at least one bottom hook, wherein the bottom arms are positioned between the stem and the bottom hook. The bottom hook is configured to engage a purse handle.

Another embodiment of the invention includes at least one top arm. The top arm is preferably extendible, collapsible, rotatable; and is able to extend proximally along the elevated surface to help balance the purse hanger when in use.

Another embodiment of the invention includes a table side engagement portion, which is configured to enable the purse hanger to engage an elevated surface with essentially flat sides.

Another embodiment of the invention includes a top knob; and a linking device. The top knob is configured to engage a purse handle. The top arm is positioned between the top hook and the top knob. The top knob is used when the height of a table or a chair seat is very short, so that it will avoid having the purse touch the floor. The linking device is preferably attached to the bottom hook. Finally, the stem is preferably extendible.

The invention is a hanger for purses and other bags, such as, handbags and shopping bags. The invention includes a shelf to place on small articles, such as books, notebooks, paper bags, and other devices that cannot hang on a standard bottom purse hook.

The hanger can be placed on tables, chair backs, chair seats, chair arms, bar tops, bar stools, shelves, racks, and other objects with a horizontal surface. The purse hanger is a very useful tool to have in restaurants, seminars, classrooms, meeting rooms, and other locations where a person is seated for long periods of time.

The purse hanger is mounted on top of a table or a chair arm or seat and a purse is hooked on a bottom hook of the hanger. The purse is supported above the ground while hanging over the side of the table top or chair arm or seat. The hanger is preferably foldable. The top and bottom arms can be folded onto the stem so that the hanger takes on a compact configuration when not in use.

The purse hanger preferably includes a key chain, or key ring, which is attached to the bottom hook. The key ring allows the purse hanger to engage with and hang from the handle of a purse or other type of bag when it is not in use.

The purse hanger is also designed to be able to engage a wide variety of essentially flat surfaces, including those surfaces that have flat sides all the way to the ground.

Other features and advantages are inherent in the push-up exercise device claimed and disclosed will become apparent to those skilled in the art from the following detailed description and its accompanying drawings.

DETAILED DESCRIPTION OF THE DRAWINGS

In the following detailed description of the preferred embodiment, reference is made to the accompanying drawings that form a part hereof, and in which is shown, by way of illustration, a specific embodiment in which the invention may be practiced. It is to be understood that other embodiments may be utilized and structural changes may be made without departing from the scope of the present invention.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

Figure 1:
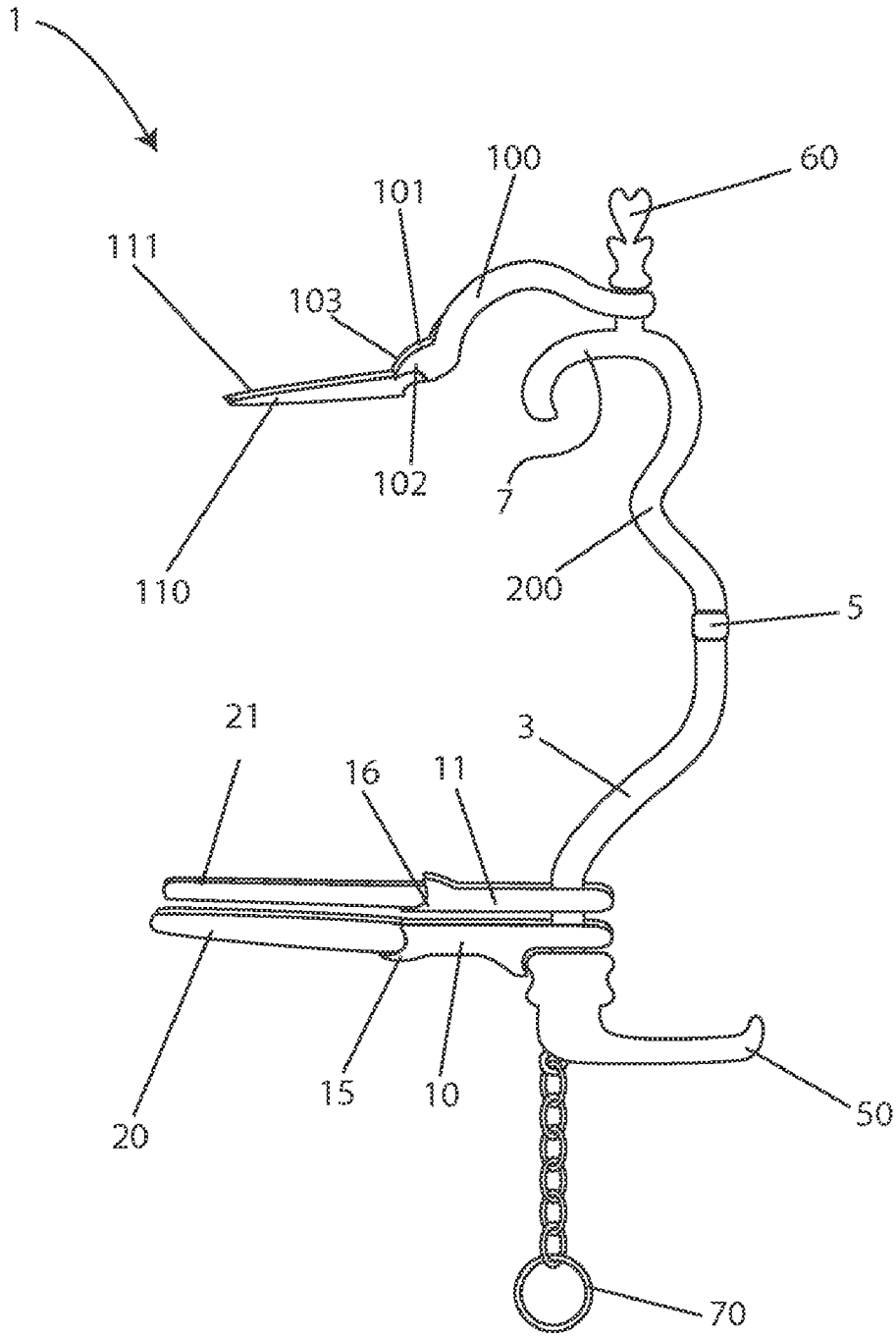
FIG. 1 is an illustration of a side view of one embodiment of the purse hanger and shows the top and bottom arms unfolded.

FIG. 1 is an illustration of a side view of one embodiment of the purse hanger and shows the top and bottom arms unfolded. As shown in FIG. 1, the purse hanger 1, includes stem 3, stem extension 5, top hook 7, bottom arms 10 and 11, bottom arm hinge stops 15 and 16, bottom arm middle extensions 20 and 21, bottom hook 50, top knob 60, linking device 70, top arms 100 and 101, top arm extensions 110 and 111, top arm hinge stops 102 and 103, and table side engagement portion 200. FIG. 1 shows how top arms 100 and 101 are preferably in between top knob 60 and top hook 7. FIG. 1 also shows how bottom arms 10 and 11 (and bottom arms 12 and 13 (not referenced in FIG. 1) are preferably in between stem 3 and bottom hook 50. The bottom arm hinge stops 15 and 16 allow bottom arm middle extensions 20 and 21 to unfold outward and downward until the bottom arm middle extensions 20 and 21 are essentially parallel with the ground. The top arm hinge stops 102 and 103 allow top arm extensions 110 and 111 to unfold outward until the top arm extensions 110 and 111 are extended away from the stem 3.

Figure 2:
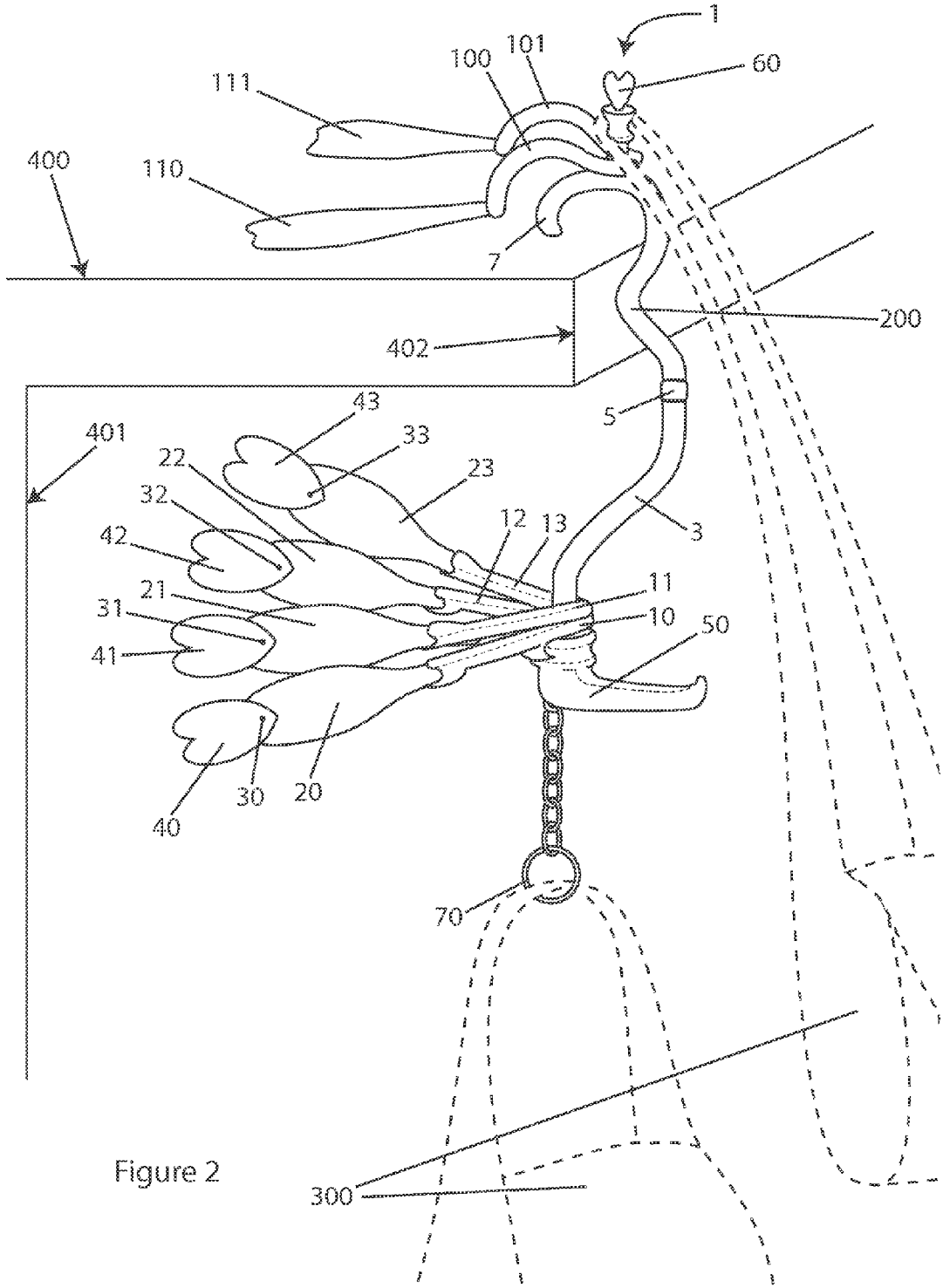
FIG. 2 is an illustration of a side view of one embodiment of the purse hanger and shows the purse hanger supporting a purse, hanging from a table with a lip, and with the top and bottom arms unfolded and extended.

FIG. 2 is an illustration of a side view of one embodiment of the purse hanger and shows the purse hanger supporting a purse, hanging from a table with a lip, and with the top and bottom arms unfolded and extended. As shown in FIG. 2, the purse hanger 1, includes stem 3, stem extension 5, top hook 7, bottom arms 10, 11, 12, and 13, bottom arm middle extensions 20, 21, 22, and 23, bottom arm swivel hinges 30, 31, 32, and 33, bottom arm swivel extensions 40, 41, 42, and 43, bottom hook 50, top knob 60, linking device 70, top arms 100 and 101, top arm extensions 110 and 111, and table side engagement portion 200. Although linking device 70 is shown as a combined key ring and key chain, linking device 70 can be any type of chain, ring, cord, or band. FIG. 2 shows how the purse hanger 1 interacts with purses 300 via the linking device 70 or top knob 60. Additionally, a purse may also be hooked onto bottom hook 50. The purse hanger 1 is shown engaging with table 400. Table 400 has a table lip 402 and a table leg 401 that is out of the way of the lower portion of purse hanger 1 when purse hanger 1 is hanging from the top of table 400. FIG. 2 shows how table side engagement portion 200 engages with the lip of the table. The bottom arms 10, 11, 12, and 13, bottom arm middle extensions 20, 21, 22, and 23, and bottom arm swivel extensions 40, 41, 42, and 43, are shown unfolded and extended so that they create a wide flat surface upon which a user can place flat objects, such as books.

FIG. 2 also shows how purse hanger 1 preferably includes top arms 100 and 101 and top arm extensions 110 and 111. The top arm extensions 110 and 111, when unfolded engage the top of table 400 and provide additional support for purse hanger 1. Preferably the tip of top hook 7 and the bottom of the top arm extensions 110 and 111 are made of an anti-slip material to better grip table 400. FIG. 2 shows how bottom arm swivel hinges 30, 31, 32, and 33, allow bottom arm swivel extensions 40, 41, 42, and 43 to swivel away from bottom arm middle extensions 20, 21, 22, and 23 to increase the size of the shelf created by the bottom arms. Finally FIG. 2 shows how the bottom arms 10, 11, 12, and 13 and top arms 100 and 101 rotate around stem 3 and can be positioned to best create a flat shelf or provide support to top hook 7. Preferably both sets of arms are rotatable to over 180 degrees. The top arms 100 and 101 provide significant support when they are 90 degrees to each other. FIG. 2 shows how the shelf created by the bottom arms is rotated so that it is directly under table 400 and out of the way of any passerby.

Although the top and bottom arms, and all the extendible arm parts, are shown in FIG. 2 as a specific size and interrelationship, it should be known that the arms and extensions can be of any size, configuration, and interrelationship, so long as the arms provide a shelf or help balance and support the purse hanger 1.

Figure 3:
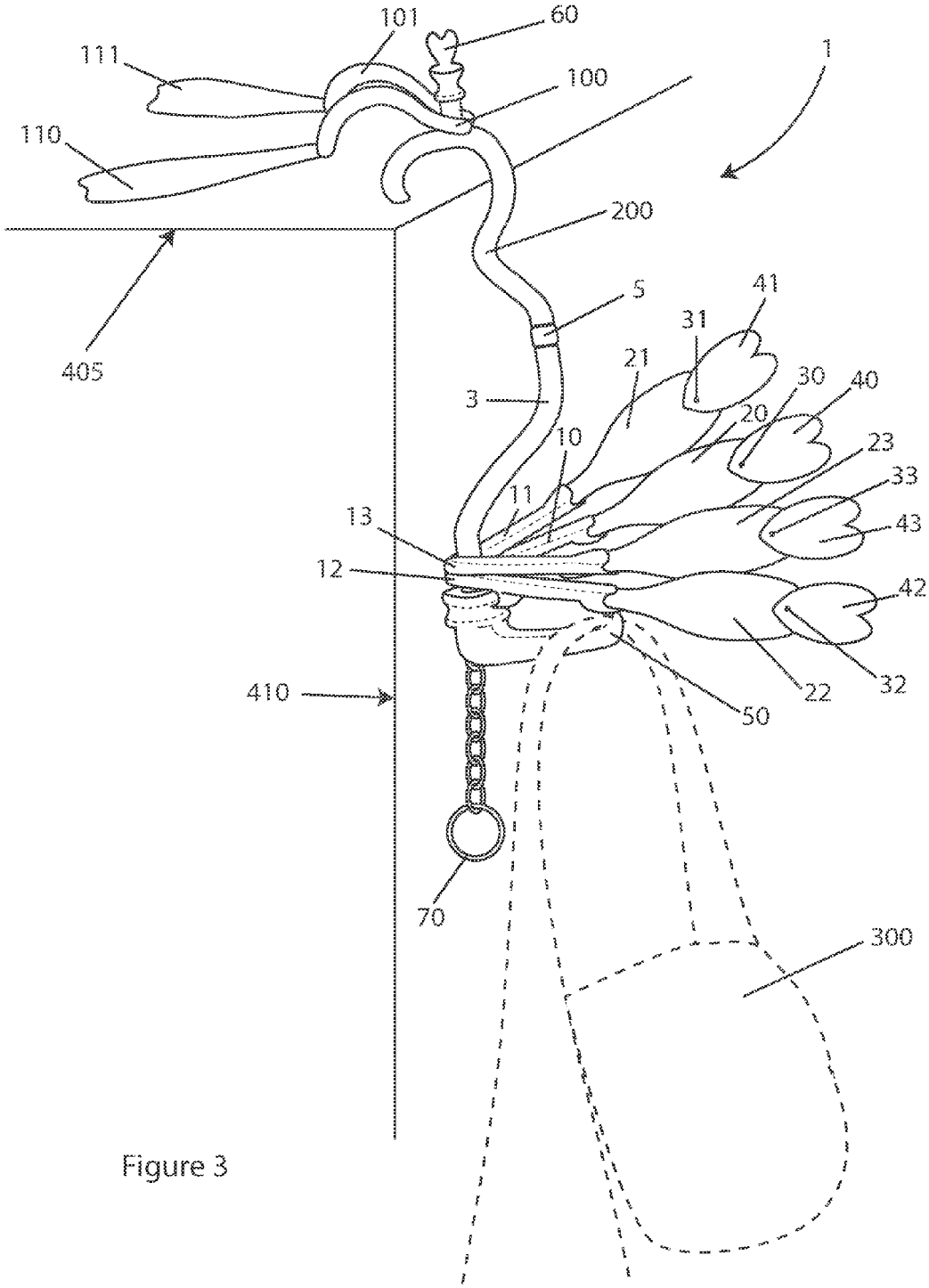
FIG. 3 is an illustration of a side view of one embodiment of the purse hanger and shows the purse hanger hanging from a table with a flat side and with the top and bottom arms unfolded and extended.

FIG. 3 is an illustration of a side view of one embodiment of the purse hanger and shows the purse hanger hanging from a table with a flat side and with the top and bottom arms unfolded and extended. As shown in FIG. 3, the purse hanger 1, includes stem 3, stem extension 5, bottom arms 10, 11, 12, and 13, bottom arm middle extensions 20, 21, 22, and 23, bottom arm swivel hinges 30, 31, 32, and 33, bottom arm swivel extensions 40, 41, 42, and 43, bottom hook 50, top knob 60, linking device 70, top arms 100 and 101, top arm extensions 110 and 111, and table side engagement portion 200. FIG. 3 shows how purse hanger 1 engages with a table 405 with no lip and a long flat table side 410. Table engagement portion 200 allows the purse hanger 1 to hang down table side 410. Purse hanger 1 does not need to extend directly below the top of table 405. FIG. 3 also shows how the bottom arms 10, 11, 12, and 13, bottom arm middle extensions 20, 21, 22, and 23, bottom arm swivel hinges 30, 31, 32, and 33, and bottom arm swivel extensions 40, 41, 42, and 43, create a shelf that is rotated away from table 405. Finally, as shown in FIG. 3, a purse 300 may be hooked onto bottom hook 50.

Figure 4:
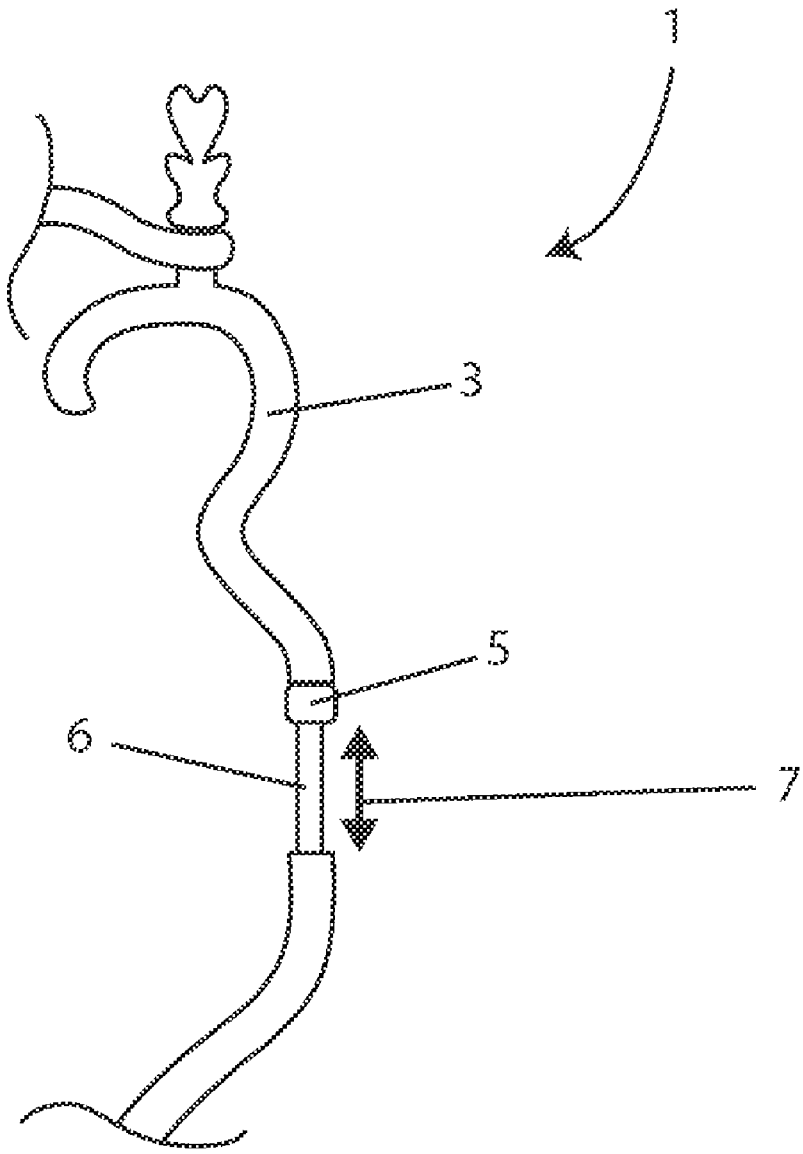
FIG. 4 is a close up illustration of a side view of one embodiment of the purse hanger and shows that the stem of a purse hanger is extendible.

FIG. 4 is a close up illustration of a side view of one embodiment of the purse hanger and shows that the stem of a purse hanger is extendible. FIG. 4 shows purse hanger 1 with stem 3, stem extension 5, and stem extension rod 6. Preferably stem extender portion has one side that disengages with stem 3 and the stem extension rod 6, which is telescopically hidden in stem 3, is exposed when stem 3 is extended. Movement arrow 7 shows how the stem is extended by extension rod 6. The stem extension 5 allows purse hanger 1 to engage a wider variety of table tops.

Figure 5:
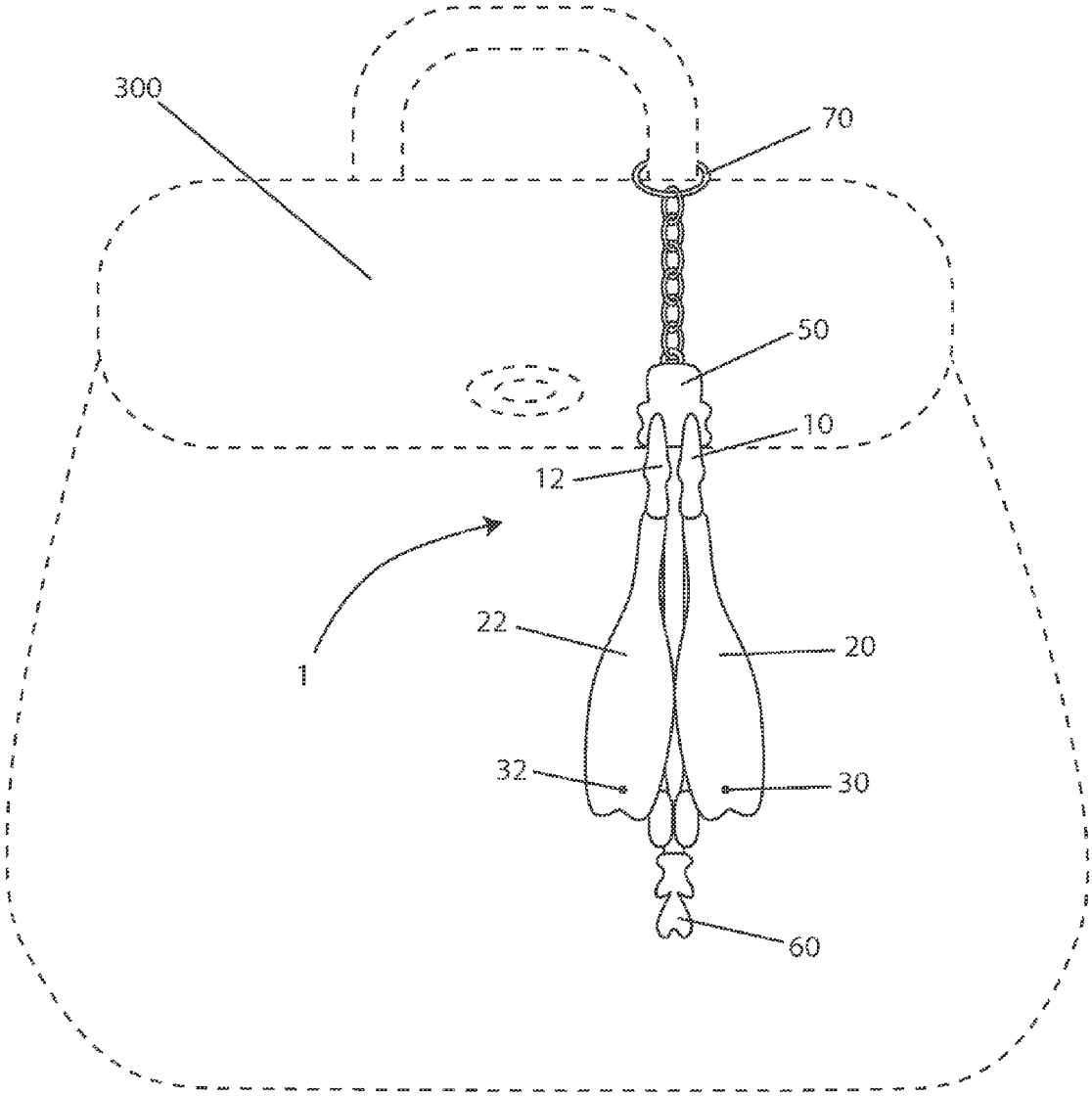
FIG. 5 is an illustration of a back view of one embodiment of the purse hanger and shows the purse hanger collapsed, folded, and attached to a purse.

FIG. 5 is an illustration of a back view of one embodiment of the purse hanger and shows the purse hanger collapsed, folded, and attached to a purse. FIG. 5 shows purse hanger 1 engaged with purse 300 when purse hanger 1 is not in use. Purse hanger 1 is shown with top knob 60, linking device 70, bottom hook 50, bottom arms 10 and 12, bottom arm middle extensions 20 and 22, and bottom arm swivel hinges 30 and 32. The bottom arm swivel extensions are not visible because they are swiveled up and underneath of the bottom arm middle extensions 20 and 22. FIG. 5 shows how the purse hanger 1 is an attractive adornment to a purse 300 when the purse hanger 1 is not in use.

Figure 6:
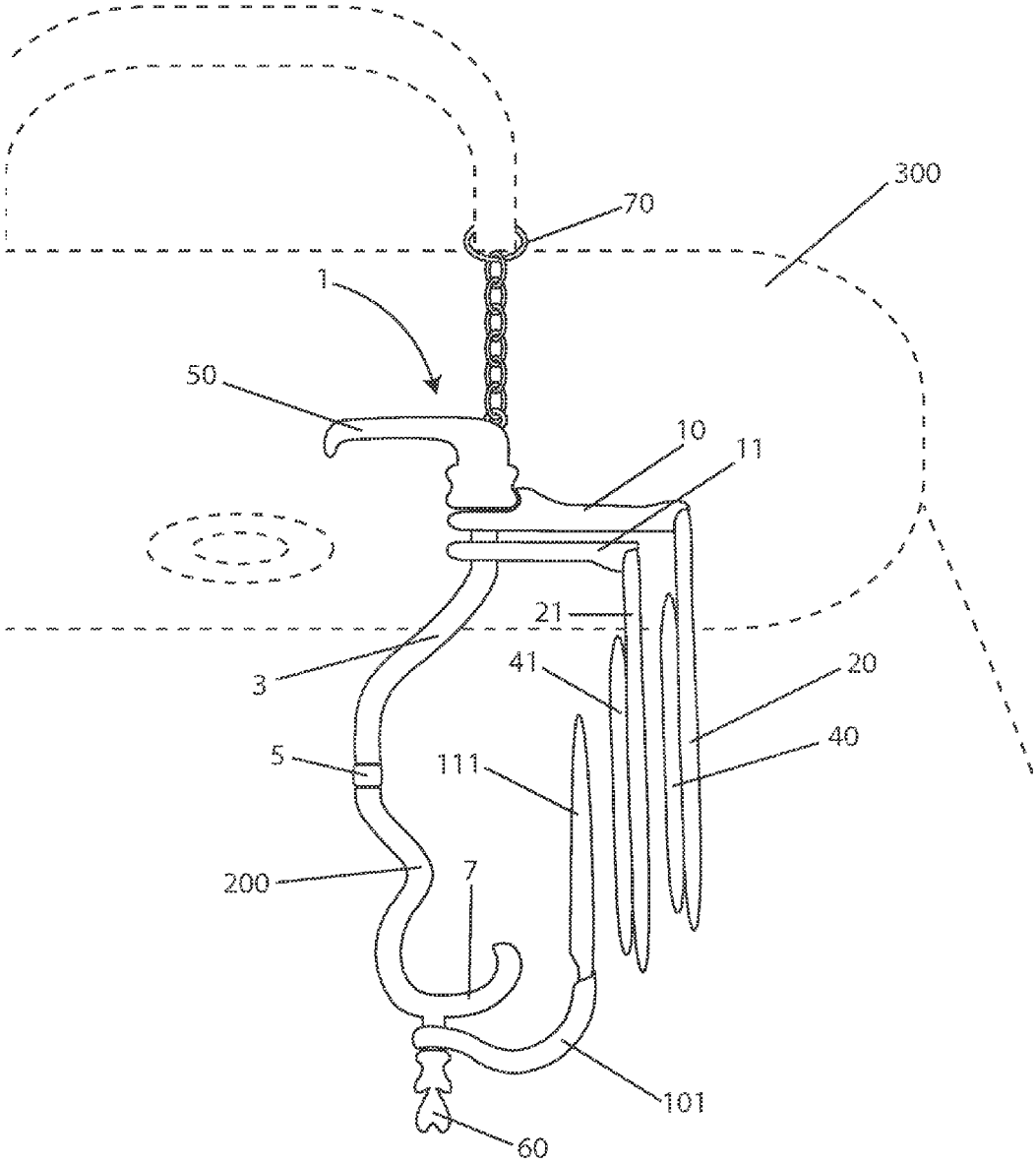
FIG. 6 is an illustration of a side view of one embodiment of the purse hanger and shows the purse hanger collapsed, folded, and attached to a purse.

FIG. 6 is an illustration of a side view of one embodiment of the purse hanger and shows the purse hanger collapsed, folded, and attached to a purse. As shown in FIG. 6, the purse hanger 1 includes stem 3, stem extension 5, bottom arms 10 and 11, bottom arm middle extensions 20 and 21, bottom arm swivel extensions 40 and 41, bottom hook 50, top knob 60, linking device 70, top arm 101, top arm extension 111, and table side engagement portion 200. FIG. 6 shows how the purse hanger 1 preferably folds to a small size for easy transport. Purse hanger 1 connects easily to purse 300 via linking device 70.

Figure 7:
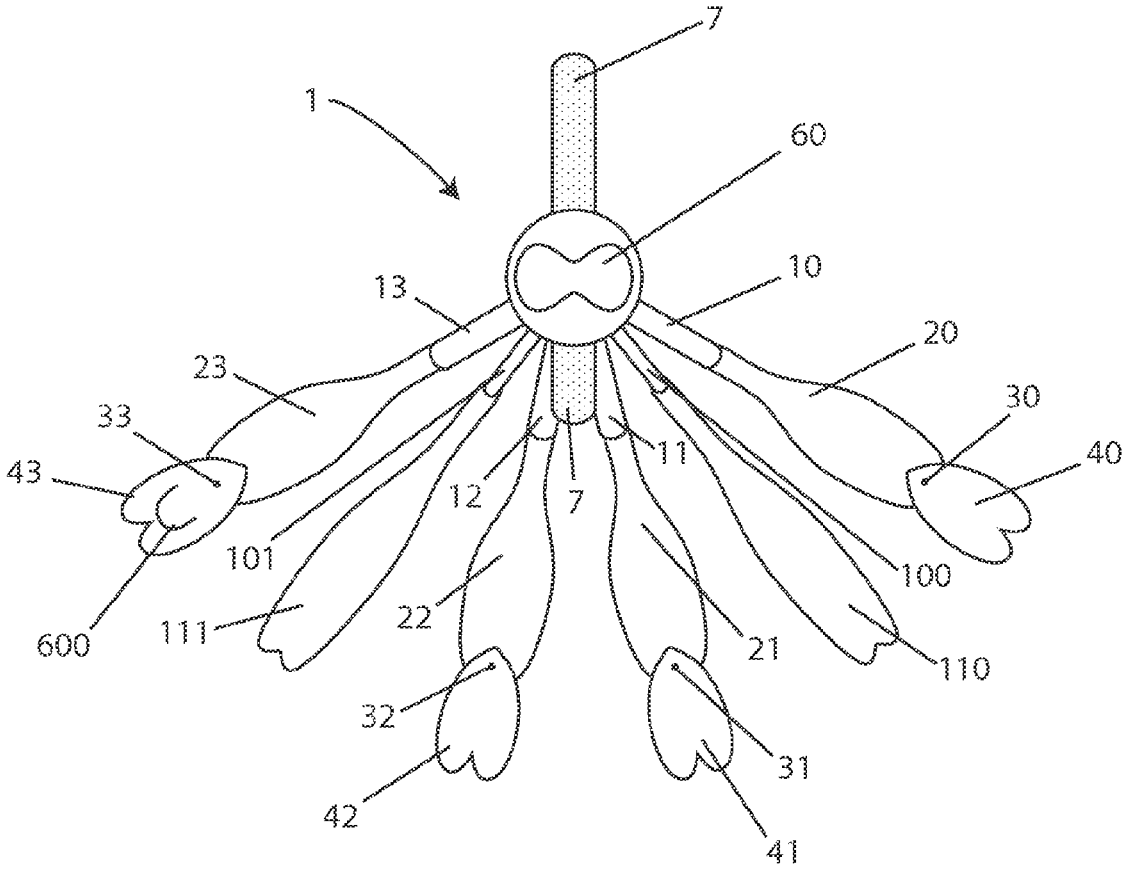
FIG. 7 is an illustration of a top view of one embodiment of the purse hanger and shows the purse hanger top and bottom arms unfolded and extended.

FIG. 7 is an illustration of a top view of one embodiment of the purse hanger and shows the purse hanger top and bottom arms unfolded and extended. As shown in FIG. 7, the purse hanger 1, top hook 7, bottom arms 10, 11, 12, and 13, bottom arm middle extensions 20, 21, 22, and 23, bottom arm swivel hinges 30, 31, 32, and 33, bottom arm swivel extensions 40, 41, 42, and 43, top knob 60, top arms 100 and 101, and top arm extensions 110 and 111. FIG. 7 shows how the top arms 100 and 101 are preferably rotated at approximately 90 degrees to each other to provide balance and support to top hook 7. FIG. 7 also shows a bird's-eye view of the shelf that is created by the bottom arms when all parts of the bottom arms are unfolded and extended. FIG. 7 also shows how the bottom arms may include one or more clips 600. The clip 600 allows the arms to hold a small amount of paper, a pen, or some other small object.

FIG. 7 shows the bottom arms 10, 11, 12, and 13, bottom arm middle extensions 20, 21, 22, and 23, bottom arm swivel extensions 40, 41, 42, and 43, top arms 100 and 101, and top arm extensions 110 and 111 with a specific shape and size. It should be understood that all parts of the purse hanger 1 may be of any size, any size relative to the other parts of purse hanger 1, and may be any shape. Preferably the parts of purse hanger 1 are flat and have a shape that is conducive to accomplishing the task that the part accomplished. Additionally, although only two top arms and four bottom arms are shown in FIG. 7, there may be any number of bottom arms or top arms. The bottom arms and top arms can be made from any number of individual parts. The parts of the bottom arms and top arms, in addition to swiveling and folding together, may interconnect through any means, including snapping together or telescoping into one another.

In order to help hold various objects, the bottom arm pieces may be made out of an anti-slip material, such as rubber, that helps secure the held object via friction.

The bottom arm and top arm pieces are preferably held together with a pin or a rivet, but the pieces may be connected using any means that will allow proper swiveling, interaction, folding, or telescoping, including, but not limited to: straps, zip-ties, chains, clips, binders, bungees, cords, ropes, strings, cables, hinges, fasteners, staples, hook and loop, friction, bands, latches, stitches, snaps, wenches, glue, other natural or synthetic chemical adhesives, adhesive tape, heat bonding, chemical bonding, crimps, clamps, or ultrasonic welding.

Purse hanger 1 is preferably made out of a light weight metal, but can be made from any natural or synthetic material, including, but not limited to: metal; metal alloy; wood or other fibrous plant product such as hemp, paper, or cardboard; glass; composite materials such as graphite, fiberglass, boron, or Kevlar; admixtures of plastic resins combined with metal, metal alloy, wood or other fibrous plant product, glass, or composite materials; plastic; animal materials such as wool, bone, or hardened leather; or any combination of these materials, without departing from the scope of the present invention.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. A purse hanger, comprising:

a top hook;

a stem; and a plurality of bottom arms;

wherein said plurality of bottom arms are extendible and collapsible;

wherein said plurality of bottom arms, when extended, create a shelf;

wherein said top hook is configured to engage an elevated surface; and wherein said shelf is essentially parallel to a ground;

wherein said plurality of bottom arms are rotatable;

wherein at least one of said plurality of bottom arms has an end portion that is comprised of a clip.

2. The purse hanger of claim 1, further comprising:

at least one bottom hook;

wherein said plurality of bottom arms are positioned between said stem and said at least one bottom hook; and wherein said at least one bottom hook is configured to engage a purse handle.

3. The purse hanger of claim 2, further comprising:

at least one top arm;

wherein said at least one top arm is extendible and collapsible.

4. The purse hanger of claim 3, wherein said at least one top arm is rotatable; and wherein said at least one top arm rotates to extend proximally along said elevated surface; and wherein said at least one top arm balances said purse hanger on said elevated surface.

5. The purse hanger of claim 4, further comprising:

a top knob; and a linking device;

wherein said top knob is configured to engage a purse handle; and wherein said at least one top arm is positioned between said top hook and said top knob;

wherein said linking device is attached to said at least one bottom hook; and wherein said stem is extendible.

6. The purse hanger of claim 4, wherein said stem is comprised of a table side engagement portion; and wherein said table side engagement portion is configured to enable said purse hanger to engage an elevated surface with flat sides.

7. The purse hanger of claim 6, further comprising:

a top knob; and a linking device;

wherein said top knob is configured to engage a purse handle;

wherein said at least one top arm is positioned between said top hook and said top knob;

wherein said linking device is attached to said at least one bottom hook; and wherein said stem is extendible.

8. The purse hanger of claim 2, wherein said stem is comprised of a table side engagement portion; and wherein said table side engagement portion is configured to enable said purse hanger to engage an elevated surface with flat sides.

9. The purse hanger of claim 8, further comprising:

a top knob; and a linking device;

wherein said top knob is configured to engage a purse handle;

wherein said at least one top arm is positioned between said top hook and said top knob;

wherein said linking device is attached to said at least one bottom hook; and wherein said stem is extendible.

10. The purse hanger of claim 2, further comprising:

a top knob; and a linking device;

wherein said top knob is configured to engage a purse handle; and wherein said at least one top arm is positioned between said top hook and said top knob;

wherein said linking device is attached to said at least one bottom hook; and wherein said stem is extendible.

11. A purse hanger, comprising:

a top hook;

a stem;

at least one bottom hook;

two top arms;

wherein said top hook is configured to engage an elevated substantially flat surface; and wherein said at least one bottom hook is configured to engage a purse handle;

wherein said two top arms are positioned on opposite sides of said top hook and wherein said two top arms balance said purse hanger on said elevated substantially flat surface.

12. The purse hanger of claim 11, wherein said two top arms are extendible and collapsible.

13. The purse hanger of claim 12, wherein said two top arms are rotatable; and wherein said two top arms rotates to extend proximally along said elevated substantially flat surface; and wherein said two top arms balances said purse hanger on said elevated substantially flat surface.

14. The purse hanger of claim 13, wherein said stem is comprised of a table side engagement portion; and wherein said table side engagement portion is configured to enable said purse hanger to engage an elevated substantially flat surface with flat sides.

15. The purse hanger of claim 14, further comprising:

a top knob; and a linking device;

wherein said top knob is configured to engage a purse handle;

wherein said two top arms are positioned between said top hook and said top knob;

wherein said linking device is attached to said at least one bottom hook; and wherein said stem is extendible.

16. The purse hanger of claim 13, further comprising:

a top knob; and a linking device;

wherein said top knob is configured to engage a purse handle;

wherein said two top arms are positioned between said top hook and said top knob;

wherein said linking device is attached to said at least one bottom hook; and wherein said stem is extendible.

17. A purse hanger, comprising:

a top knob;

at least one top arm;

a linking device;

a top hook;

a stem; and at least one bottom hook;

wherein said top hook is configured to engage an elevated substantially flat surface with flat sides;

wherein said at least one bottom hook is configured to engage a purse handle;

wherein said stem is comprised of a table side engagement portion; and wherein said table side engagement portion is configured to enable said purse hanger to engage said elevated substantially flat surface with flat sides;

wherein said top knob is configured to engage a purse handle;

wherein said at least one top arm is positioned between said top hook and said top knob;

wherein said linking device is attached to said at least one bottom hook;

wherein said at least one top arm is positioned on opposite sides of said top hook and wherein said two top arms balance said purse hanger on said elevated substantially flat surface; and wherein said stem is extendible.

18. A purse hanger, comprising:

at least one top arm;

a top hook;

a stem;

at least one bottom hook;

wherein said top hook is configured to engage an elevated substantially flat surface with flat sides;

wherein said at least one bottom hook is configured to engage a purse handle;

wherein said stem is comprised of a table side engagement portion; and wherein said table side engagement portion is configured to enable said purse hanger to engage said elevated substantially flat surface with flat sides;

wherein said at least one top arm is positioned next to said top hook and wherein said at least one top arm balances said purse hanger on said elevated substantially flat surface.

19. The purse hanger of claim 18, further comprising:

a top knob; and a linking device;

wherein said top knob is configured to engage a purse handle;

wherein said at least one top arm is positioned between said top hook and said top knob;

wherein said linking device is attached to said at least one bottom hook;

wherein said stem is extendible.

20. The purse hanger of claim 18, further comprising:

a linking device;

wherein said linking device is attached to said at least one bottom hook.

21. The purse hanger of claim 18, further comprising:

a top knob; and wherein said top knob is configured to engage a purse handle;

wherein said at least one top arm is positioned between said top hook and said top knob.

* * * * *